United States Patent [19]

Hirakawa et al.

[11] Patent Number: 4,657,236

[45] Date of Patent: Apr. 14, 1987

[54] SHEET DELIVERY DEVICE

[75] Inventors: Tadashi Hirakawa; Arifumi Okamoto, both of Mihara, Japan

[73] Assignee: Mitsubishi Jukogyo Kabushiki Kaisha, Tokyo, Japan

[21] Appl. No.: 751,011

[22] Filed: Jul. 2, 1985

[30] Foreign Application Priority Data

Jul. 20, 1984 [JP] Japan ..... 59-108922[U]

[51] Int. Cl.[4] ..... B65H 3/08

[52] U.S. Cl. ..... 271/99; 271/227; 271/261; 271/265

[58] Field of Search ..... 271/99, 227, 265, 261

[56] References Cited

U.S. PATENT DOCUMENTS

| | | | |
|---|---|---|---|
| 3,191,530 | 6/1965 | Fath | 271/261 X |
| 3,322,261 | 5/1967 | Jensen | 271/261 X |
| 3,575,411 | 4/1971 | Kastelic | 271/227 |
| 3,741,357 | 6/1973 | Krysiuk | 271/227 X |
| 4,201,378 | 5/1980 | Hams | 271/261 |
| 4,511,242 | 4/1985 | Ashbee | 271/227 X |
| 4,545,031 | 10/1985 | Kobayashi | 271/227 X |

*Primary Examiner*—Richard A. Schacher

*Attorney, Agent, or Firm*—Wenderoth, Lind & Ponack

[57] ABSTRACT

A sheet delivery device of the type in which each sheet delivered by a moving suction unit is received and delivered again by feed rolls. The sheet delivery device features a control unit which detects whether or not each sheet is delivered in synchronization with the operation timing of equipment positioned on the downstream side of delivery effected by the feed rolls and sends a signal obtained when no synchronized delivery takes place to a rotation driving unit of the feed rolls to change the revolution speed of the feed rolls thereby to realize the synchronized delivery of each sheet. Oblique delivery of the sheet is corrected by the use of divided, independently rotation controlled pairs of feed rolls.

8 Claims, 5 Drawing Figures

SHEET DELIVERY DEVICE

BACKGROUND OF THE INVENTION

1. Field of the Invention

This invention relates to a sheet delivery device adapted for use in a paper feeding device of a corrugated cardboard box making machine and the like.

2. Description of the Prior Art

Describing a conventional sheet delivery device used in a paper feeding device of an ordinary corrugated cardboard box making machine with a reference to FIGS. 3, 4 and 5, reference numerals 1*a* through 1*n* indicate corrugated cardboard sheets, 2 is a front stopper, 3 is a back stopper, 4 is a gap, 5 is a print cylinder, 6 is a lever, 7 is a link, 8 is a moving suction box, 9 is a suction hole, 10 is a slidable pipe section, 11 is a rotary valve, 12 is a suction tank, 13 is a suction blower, 14 is an upper feed roll, 15 is a lower feed roll, 16 is a crankshaft, 17 and 18 are gears, 19 is a reduction gear and the like, 20 is a motor, 22 is a crank lever, 23 is a grooved lever, 24 is a receiving roll, and 25 is a gear. The corrugated cardboard sheets 1*a* through 1*n* supplied from a preceding process are piled in a space surrounded by the front stopper 2, side guides (not shown) and back stopper 3. In order to prevent the whole weight of the piled sheets from being applied to the lowest corrugated cardboard sheet 1*a*, the sheets are divided into two stacks or layers by the back stopper 3 and one stack is piled on the other. At the lowest corrugated cardboard sheet 1*a* is delivered through the gap 4 which is formed at the lower end of the front stopper 2 and designed so as to permit passage of that lowest one 1*a*, the lowest corrugated cardboard sheet out of the upper stack falls on the lower stack. Delivery of the corrugated cardboard sheet 1*a* is carried out by the moving suction box 8 which performs reciprocation in a sheet delivery direction in response to rotation of the print cylinder 5 via the crank lever 22, grooved lever 23, lever 6 and link 7. Specifically, in response to one revolution of the print cylinder 5 the crank lever 22 rotates one turn and the mechanism composed of the grooved lever 23, lever 6 and link 7 performs one reciprocative swing, this being transmitted to the suction box 8. A portion of the moving suction box 8 which contacts the lowest corrugated cardboard sheet 1*a* is formed with a number of suction holes 9 (see FIGS. 4 and 5). The interior of the moving suction box 8 is connected to the suction blower 13 through the sealed slidable double pipe mechanism 10, rotary valve 11 and suction tank 12. The rotary valve 11 operates such that it exerts a suction pressure only while the moving suction box 8 is advancing in response to swinging of the lever 6 which is synchronized in timing such that one corrugated cardboard sheet 1*a* can be delivered in response to one revolution of the print cylinder 5. In response to the above, the moving suction box 8 sucks the corrugated cardboard sheet 1*a* and moves the same through the gap 4 formed at the lower end of the front stopper 2 thereby to deliver in the direction of the arrow at the same rate as the circumferential speed of the print cylinder 5. The thus delivered corrugated cardboard sheet 1*a* is pushed to a nip section between the upper feed roll 14 and lower feed roll 15 and then sent to the print cylinder 5 and receiving roll 24 of a succeeding process step. The print cylinder 5, upper and lower feed rolls 14, 15, and crank lever shaft 16 are coupled through the gears 17, 18, 25, reduction gear 19 and the like to the motor (single driving source) 20 and driven thereby.

In operation of the conventional sheet delivery device shown in FIGS. 3, 4 and 5, the corrugated cardboard sheet 1*a* delivered by the moving suction box 8 shows some variation in delivery timing and an error appears in a following process step (such as a printing process). Specifically, a deviation of timing appears frequently in cases as follows: (1) if the sheet is delivered at high speed (in this case, although the corrugated cardboard sheet 1*a* follows the movement of the moving suction box 8 after suction is applied, there exists some time lag before the moving suction box 8 exerts its suction effect), (2) if the corrugated cardboard sheet 1*a* has a warp as shown in FIG. 5 (in this case, due to the presence of the gap 21 such a corrugated cardboard 1*a* needs additional time after it is sucked before it should be moved; thus, it tends to be fed obliquely), (3) if the corrugated cardboard sheet 1*a* has a small coefficient of surface friction (such as a coated sheet in this case, slippage tends to occur between the sheet and the moving suction box 8).

SUMMARY OF THE INVENTION

The present invention has been devised in order to solve the foregoing problems of the prior art, and the object of the present invention is to provide an impoved sheet delivery device which can correct a deviation in delivery timing and deliver reliably a sheet to equipment positioned on the downstream side of the delivery device.

In brief, a sheet delivery device according to the present invention includes a moving suction unit for delivering a sheet and feed rolls for receiving and delivering the sheet delivered by the moving suction unit and is characterized by a control unit which detects whether or not each sheet is delivered in synchronization with the operation timing of sheet processing equipment positioned on the downstream side of delivery effected by the feed rolls and sends a signal obtained when no synchronized delivery takes place to a rotation driving unit of the feed rolls thereby to change the revolution speed of the feed rolls.

DETAILED DESCRIPTION OF THE PREFERRED EMBODIMENTS

Figure 1:
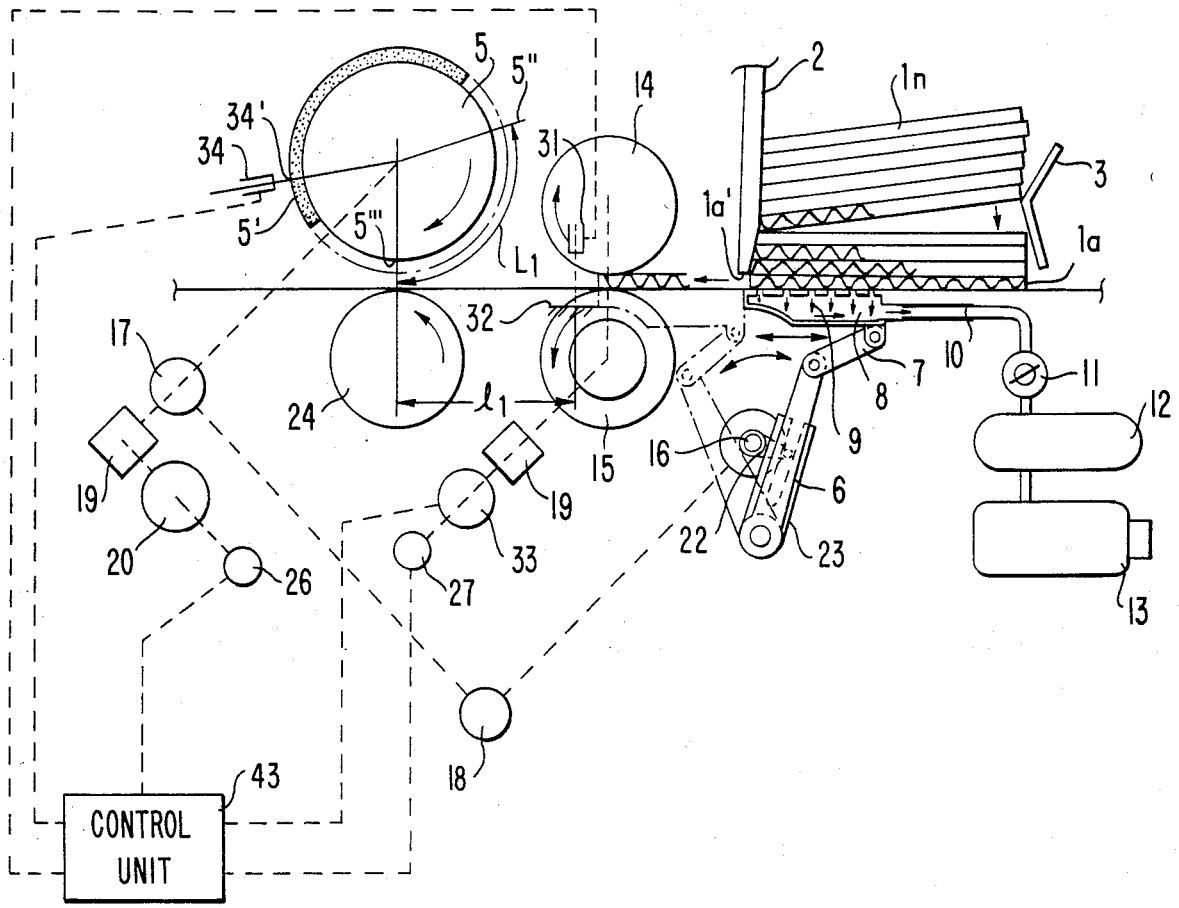
FIG. 1 is a side view showing a first embodiment of a sheet delivery device according to the present invention.
Figure 3:
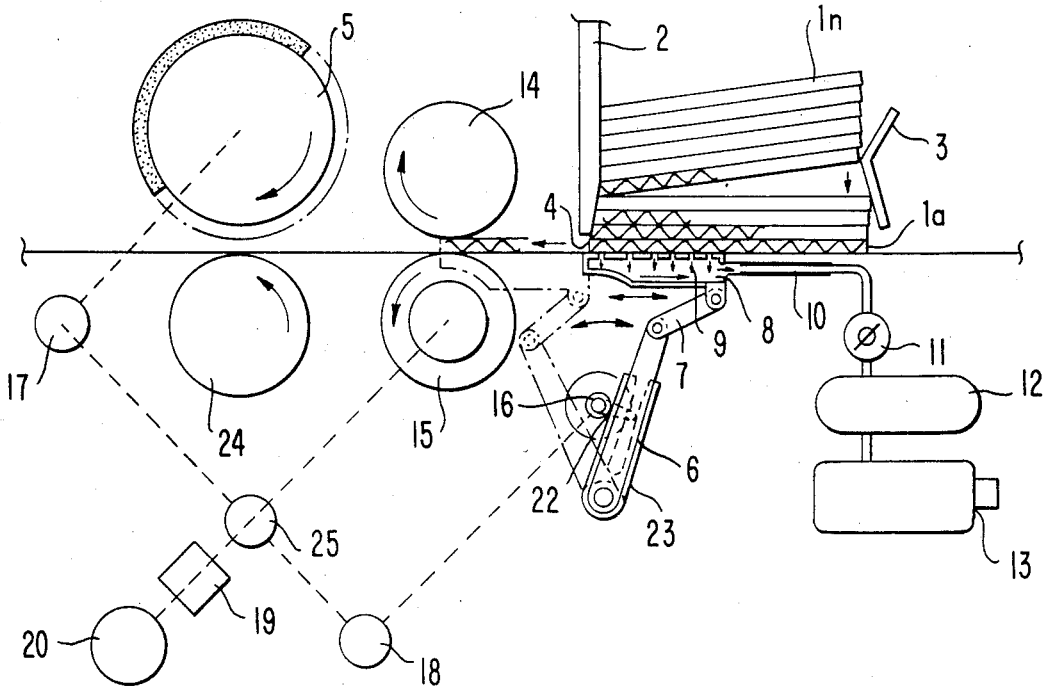
FIG. 3. (PRIOR ART)
FIG. 3 is a side view showing the conventional sheet delivery device.

A sheet delivery device according to the present invention will now be described with reference to FIG. 1 showing a first embodiment, in which reference numerals 1*a* through 1*n* indicate corrugated cardboard sheets, 2 is a front stopper, 3 is a back stopper, 5 is a print cylinder, 6 is a lever, 7 is a link, 8 is a moving suction box, 9 is a suction hole, 10 is a slidable pipe and the like, 11 is a rotary valve, 12 is a suction tank, 13 is a suction blower, 14 is an upper feed roll, 15 is a lower feed roll, 16 is a crankshaft, 17 and 18 are gears, 19 is a reduction gear and the like, 20 is a motor, 22 is a crank lever, 23 is a grooved lever, 24 is a receiving roll, 26 and 27 are pulse oscillators, 31 is a sheet position sensor means such as a phototube, 32 is a mirror, 33 is a motor, and 34 is a heat processing equipment sensor means such as a reference switch. The motor 33, pulse oscillator 26, pulse oscillator 27, reference switch 34 and phototube 31 are each individually connected to a control unit 43, shown in FIG. 1. The different aspects of the present embodiment from the conventional device include the phototube 31 and the mirror 32, which are disposed respectively above and below a passageway section of the corrugated cardboard sheets 1*a* defined between the upper feed roll 14 and the print cylinder 5, by which arrival of the corrugated cardboard sheet 1*a* at a reference position is detected. Although the conventional device used the motor 20 (the single driving source) the drive the print cylinder 5, upper and lower feed rolls 14, 15, and crank lever shaft 16, the present embodiment differs therefrom as follows. That is, in the present invention, the print cylinder 5 is driven by the motor 20 and the upper and lower feed rolls 14, 15 are driven by the motor 33. The extent of partial revolution each of the print cylinder 5, upper and lower feed rolls 14, 15 is detected by means of pulse counting with the pulse oscillators 26, 27. The delivery timing of the corrugated cardboard sheet 1*a* is made to agree with the operation timing of the print cylinder 5 by taking the reference switch 34 disposed above and opposite to the print cylinder 5 as a reference point. Other arrangements not mentioned above are identical to those of the conventional device.

Operation of the foregoing sheet delivery device shown in FIG. 1 will now be described. In order to supply one corrugated cardboard sheet 1*a* in compliance with one revolution of the print cylinder 5, the moving suction box 8, which performs one linear reciprocative motion in response to one reciprocation (swinging) of the lever 6 and link 7, delivers one corrugated cardboard sheet 1*a* in phase with the timing of the rotary valve 11 which makes effective a suction pressure only during the advancement stroke of the suction box 8. At this moment, the reference switch 34 is opposite to a reference point corresponding to a detection segment 34' provided on the print cylinder 5. The oscillator 26 is provided for pulse counting pulses corresponding to the extent of partial rotation which is given by subdividing one revolution of the print cylinder 5, whereby a set of pulses can be counted, each pulse corresponding to a fractional part of one revolution of the print cylinder 5. The pulses sent out from the oscillator 26 to the control unit 43 are cleared and restarted from zero count each time the detection segment 34' passes over the reference switch 34. The phototube 31 is provided for detection of arrival of the front end of the corrugated cardboard sheet 1*a*. The thus obtained detection signal and the foregoing pulse signal are processed by the control unit 43 to compute a degree of delay in delivery of the corrugated cardboard sheet 1*a* with respect to a degree of rotation of the print cylinder 5, and a control signal in the form of the thus obtained degree of delay is sent from the control unit to the motor 33 to control the revolution speed of the motor 33. The process of such control as above, i.e. the process of causing the detection segment 34' of the print cylinder 5 to reach the position 5''' when the front end 1*a'* of the corrugated cardboard sheet 1*a* comes to the same position 5''' of the print cylinder 5, will now be described in detail. The distance $l_1$ from the position of the phototube 31 to the position 5''' is set equal to the circumferential distance $L_1$ from the position 5'' on the print cylinder 5 to the position 5'''. Further, a certain number of pulses, for example, 100 pulses, are preset for the foregoing distance $l_1$. If the detection segment 34' of the print cylinder 5 hs passed beyond the position 5'' by a distance corresponding to the interval of three pulses at the time the front end 1*a'* of the corrugated cardboard sheet 1*a* reached the position of the phototube 31, this interval corresponding to three pulses is understood to be a delay time of the corrugated cardboard sheet 1*a*. Therefore, it is necessary to advance the corrugated cardboard sheet 1*a* a distance corresponding to 100 pulses while the print cylinder 5 rotates up to the position 5''', i.e. a circumferential distance corresponding to 97 pulses. Accordingly, by means of the foregoing control signal the revolution speed of the motor 33 is increased to increase the peripheral speed of the feed rolls 14, 15 while the corrugated cardboard sheet 1*a* is advancing a distance corresponding to the circumferential distance $L_1$. When the revolution speed is increased and has reached a given rate, the peripheral speed of the feed rolls 14, 15 is controlled so that it becomes equal to that of the print cylinder 5.

As described hereinabove, the sheet delivery device according to the present invention includes the moving suction unit for delivering a sheet and the feed rolls for receiving and delivering the sheet delivered by the moving suction unit, is characterized by the control unit 43 which detects whether or not the sheet is delivered in synchronization with the operation timing of equipment positioned on the downstream side of delivery effected by the feed rolls and sends a signal obtained when no synchronized delivery takes place to the rotation driving unit of the feed rolls thereby to change the revolution speed of the feed rolls, operates in such a manner as described hereinabove, and, thus, provides the following effect. In case the print cylinder performs high speed printing, the desired timing of the mechanical operation can easily be attained. If the suction action caused by vacuum pressure is combined with the mechanical operation, the resultant timing becomes unstable and a time lag arises. Because the sheet delivery device delivers the corrugated cardboard sheets and the like by the use of the moving suction unit, variation easily occurs in delivery timing of the corrugated cardboard sheets and the like. However, the present device having the foregoing structure and operating in the foregoing manner can correct any deviation of timing and effectively deliver the corrugated cardboard sheets and the like to the print cylinder or like sheet processing equipment or units.

Figure 2:
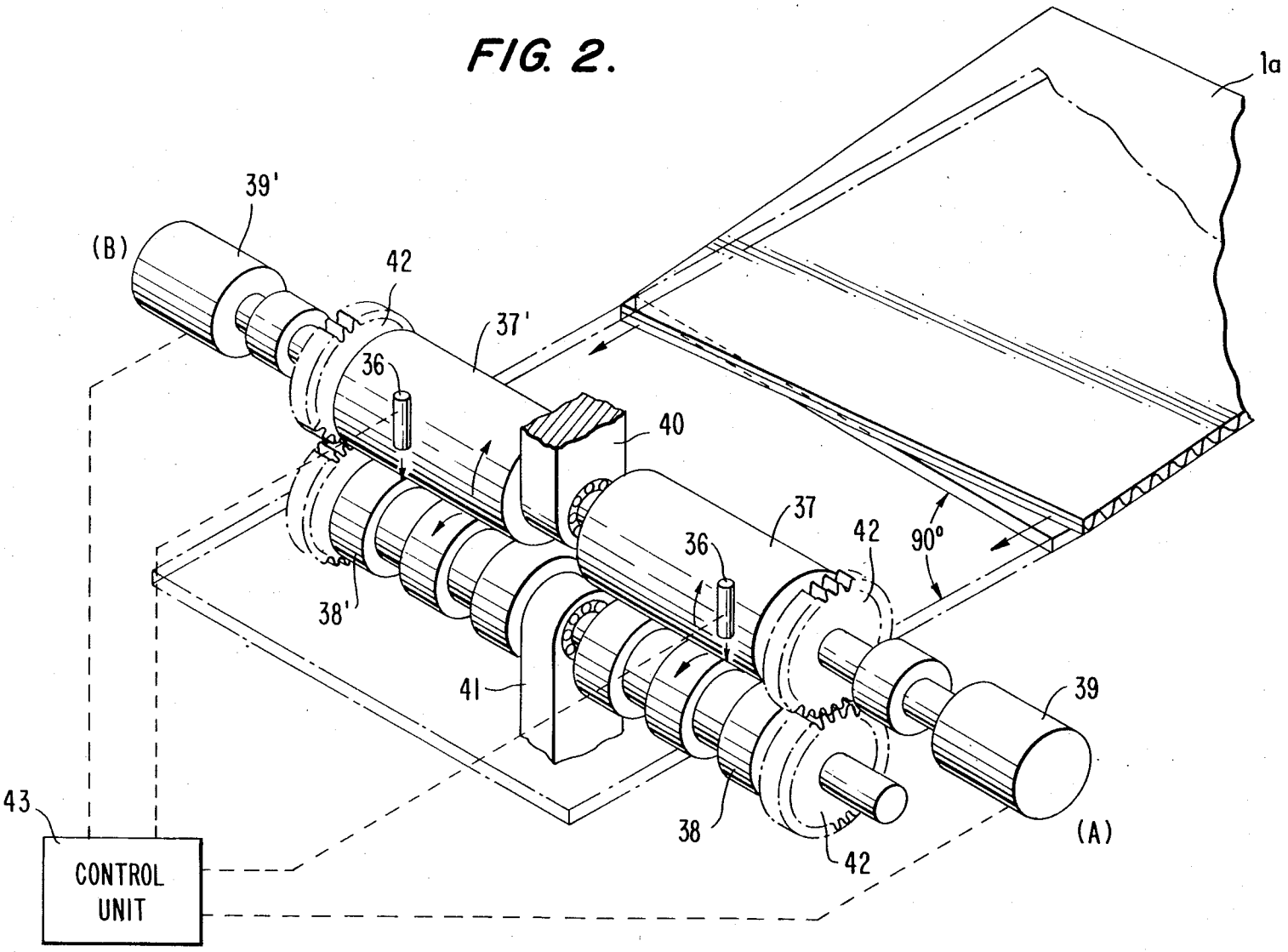
FIG. 2 is a perspective view showing a second embodiment of the present invention.
Figure 4:
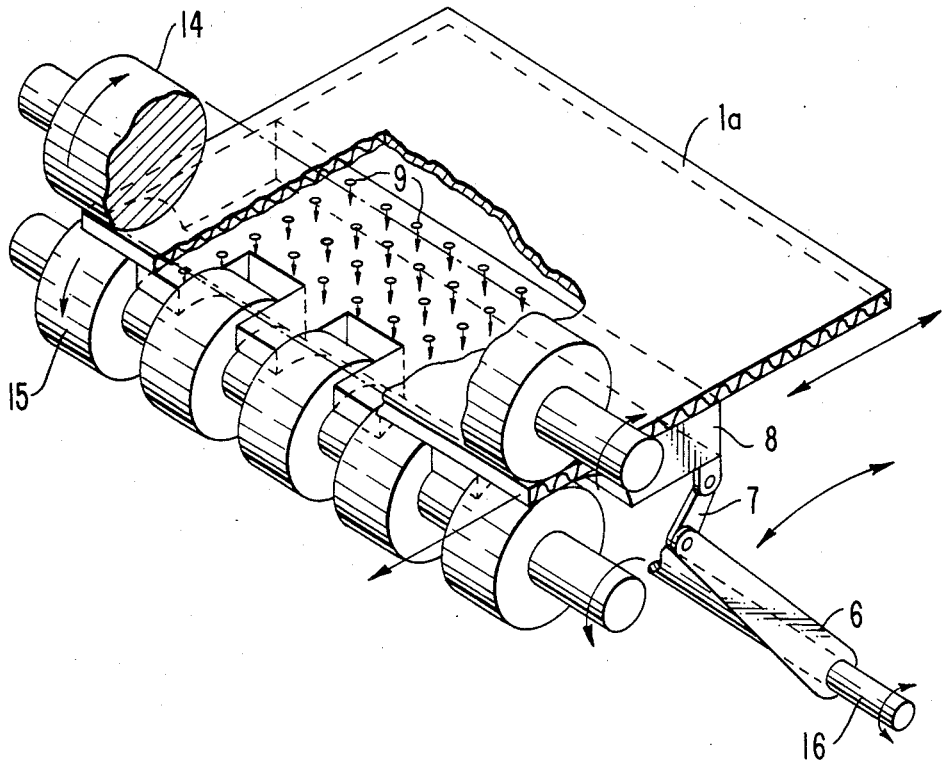
FIG. 4. (PRIOR ART)
FIG. 4 is a perspective view of a feed roll section of the device shown in FIG. 3.

A second embodiment of the sheet delivery device according to the present invention will now be described with reference to FIG. 2. In this second embodiment, a sheet orientation sensor means such as a plurality of phototubes 36, are arranged on a vertical surface perpendicular to the advancing direction of the corrugated cardboard sheet 1*a* between a first upper feed roll 37 and a second upper feed roll 37' and the print cylinder 5 (see FIG. 1), and detect arrival of the corrugated cardboard sheet 1*a*. The upper and lower feed rolls are divided with respect to the transverse of the feed roll assembly center into a first A-side feed roll 37 and a second B-side feed roll 37', the adjacent ends of the upper feed rolls 37, 37', near the transverse center of the feed roll assembly, are supported rotatably by an upper bearing 40, and the opposite ends of the rolls 37, 37' are coupled to an A-side motor 39 and a B-side motor 39', respectively. A first lower feed roll 38 and a second lower feed roll 38' are structured similarly to the above, except for the motors 39, 39'. The A-side upper and lower feed rolls 37, 38 are rotated in the respective directions of the arrows by the A-side motor 39 via a pair of gears 42, and the B-side upper and lower feed rolls 37', 38' are rotated in the respective directions of the arrows by the motor 39' similarly to the A-side unit.

Figure 5:
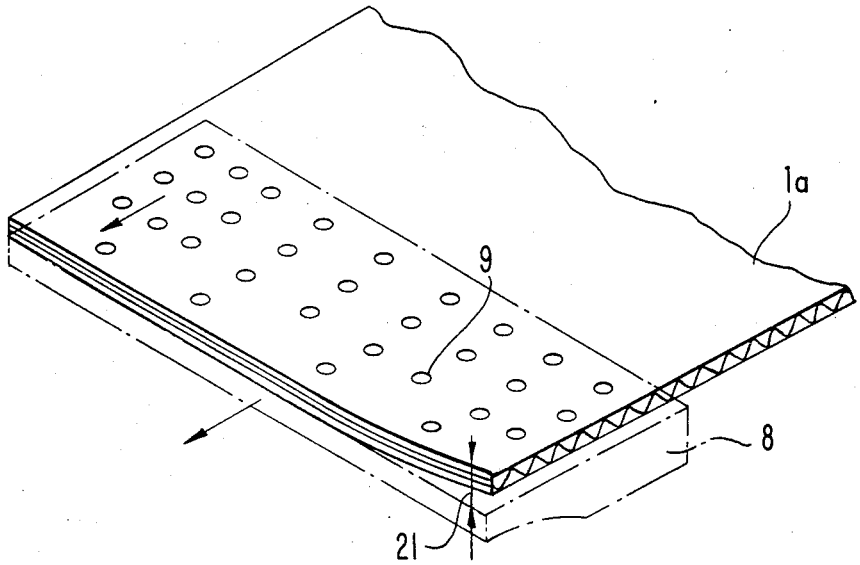
FIG. 5. (PRIOR ART)
FIG. 5 is a perspective view showing a sheet with warps.

Operation of the foregoing sheet delivery device shown in FIG. 2 will now be described. The corrugated cardboard sheet 1*a* with warps needs a long time before complete suction is effected because of the presence of the gap 21, and tends to be fed obliquely, as shown in FIG. 5. In this second embodiment, passage of the corrugated cardboard sheet 1*a* delivered obliquely is detected by the plurality of phototubes 36, whereby positional discrepancy between the left end and right end of the sheet is adjusted in orientation by means of a control unit 43, which is connected to the motors 39, 39' and the phototubes 36, for rotation control over the A-side upper and lower feed rolls 37, 38 and the B-side upper and lower feed rolls 37', 38' before the corrugated cardboard sheet 1*a* reaches the print cylinder 5. The process of sheet orientation adjustment control on the second embodiment is similar to the first embodiment shown in FIG. 1. Specifically, in the second embodiment, the motors 39, 39' for the A-side upper and lower feed rolls 37, 38 and the B-side upper and lower feed rolls 37', 38' are controlled individually by the control unit 43. In the exemplary state shown in FIG. 2, the right end of the corrugated cardboard sheet 1*a* deviates rearward with respect to the left and right phototubes 36, 36; thus, the revolution speed of the A-side upper and lower feed rolls 37, 38 must be increased in comparison to the B-side upper and lower feed rolls 37', 38'. In the case of using the divided feed rolls, the set of upper and lower feed rolls 14, 15 shown in FIG. 1 is merely replaced by the set of divided feed rolls.

Similarly to the first embodiment, the second embodiment of the sheet delivery device according to the present invention shown in FIG. 2 and described hereinabove includes the moving suction unit for delivering a sheet and the feed rolls for receiving and delivering the sheet delivered by the moving suction unit, is characterized by the control unit 43 which detects whether or not the sheet is delivered in synchronization with the operation timing of sheet processing equipment positioned on the downstream side of delivery effected by the feed rolls and sends a signal obtained when no synchronized delivery takes place to the rotation driving unit of the feed rolls thereby to change the revolution speed of the feed rolls, and provides the same effect as that of the first embodiment shown in FIG. 1. In addition, the second embodiment provides the advantage that it can take away a deviation in desired orientation of the sheet which tends to appear between the left and right end portions before the sheet is sucked by the moving suction unit or in the course of delivery action due to warps and/or delivery resistance of the sheet that may cause the sheet to be delivered obliquely.

While the preferred embodiments have been described, variations thereto will occur to those skilled in the art within the scope of the present inventive concepts which are delineated by the following claims.

What is claimed is:

1. A sheet delivery device comprising:

a movable suction unit for moving individual sheets in a sheet delivery direction away from a sheet supply position at which one or more sheets are supplied to said delivery device;

sheet processing equipment located along said sheet delivery direction for processing each sheet moved by said movable suction unit;

feed rolls positioned between said movable suction unit and said sheet processing equipment for delivering sheets from said movable suction unit to said sheet processing equipment, said feed rolls including at least one first roll, a first motor connected to said first roll, at least one second roll spaced from said first roll in a direction perpendicular to said sheet delivering direction and a second motor connected to said second roll, said first and second motors being operable to correct the orientation of each sheet by independently rotating said first and second rolls at different speeds and said first and second motors being operable to adjust the speed of delivery of each sheet to correspond to the operation of said sheet processing equipment;

sheet orientation sensor means for detecting the orientation of each sheet delivered by said feed rolls;

sheet processing equipment sensor means for detecting a reference point in operation of said sheet processing equipment;

sheet position sensor means for detecting when each sheet arrives at a reference position; and control unit means connected to said first and second motors, said sheet orientation sensor means, said sheet processing equipment sensor means and said sheet position sensor means for individually controlling rotation of said first and second rolls to correct any deviation in the orientation of each sheet and for controlling the speed of delivery of each sheet to correspond with the operation of said sheet processing equipment.

2. The sheet delivery device of claim 1, wherein said sheet processing equipment comprises a print cylinder and said sheet processing equipment senor means comprises a reference switch and a detection segment corresponding to said reference point, said detection segment being located on said print cylinder, said reference switch being fixedly positioned for actuation by said detection segment when said detection segment passes said reference switch due to rotation of said print cylinder.

3. The sheet delivery device of claim 1, wherein said sheet position sensor means comprises a phototube fixedly positioned at a reference position along said sheet delivery direction and a mirror fixedly positioned opposite said phototube, said phototube and said mirror being located on opposite sides of the path of a sheet delivered by said feed rolls whereby the arrival of a sheet at said reference position is detected by said sheet position sensor means.

4. The sheet delivery device of claim 1, wherein said sheet orientation sensor means includes a plurality of phototubes fixedly positioned and spaced from each other in a direction perpendicular to said sheet delivery direction, whereby the deviation in orientation of a sheet delivered by said feed rolls is detected.

5. The sheet delivery device of claim 1, further including a first pulse oscillator for detecting the operation timing of said sheet processing equipment and a second pulse oscillator of detecting the operation timing of said feed rolls, said first and second pulse oscillator being connected to said control unit means, whereby the delivery timing of each sheet is controlled by said control unit means by comparing signals from said first and second pulse oscillators and adjusting the speed of said first and second feed rolls.

6. The sheet delivery device of claim 1, wherein said at least one first roll comprises an upper and a lower feed roll and said at least one second feed roll comprises an upper and lower feed roll, whereby each sheet is passed between said upper and lower feed rolls.

7. The sheet delivery device of claim 1, wherein the sheet is a corrugated cardboard sheet.

8. The sheet delivery device of claim 1, wherein said movable suction unit includes a suction box which is reciprocated along said sheet feeding direction, said suction box being positioned to move a lowermost sheet of a stack of sheets away from said sheet supply position.

* * * * *